United States Patent [19]

Ammon et al.

[11] Patent Number: 4,941,928

[45] Date of Patent: Jul. 17, 1990

[54] METHOD OF FABRICATING SHAPED BRITTLE INTERMETALLIC COMPOUNDS

[75] Inventors: Robert L. Ammon, Baldwin Boro; Raymond W. Buckman, Pleasant Hills; George P. Sabol, Murrysville, all of Pa.

[73] Assignee: Westinghouse Electric Corp., Pittsburgh, Pa.

[21] Appl. No.: 292,033

[22] Filed: Dec. 30, 1988

[51] Int. Cl.[5] ..... B23K 20/14

[52] U.S. Cl. ..... 148/2; 420/420; 420/421; 427/34; 427/422; 29/527.5

[58] Field of Search ..... 148/11.5 F; 420/420, 420/421; 437/34, 422; 75/0.5 C

[56] References Cited

U.S. PATENT DOCUMENTS

| | | | |
|---|---|---|---|
| 3,575,783 | 4/1971 | Kreider | 161/143 |
| 3,596,344 | 8/1971 | Kreider | 29/191.4 |
| 3,606,667 | 9/1971 | Kreider | 29/423 |
| 3,615,277 | 10/1971 | Kreider | 29/472.3 |
| 3,717,443 | 2/1973 | McMurray et al. | 29/191 |
| 4,027,367 | 6/1977 | Rondeau | 427/37 |
| 4,134,759 | 1/1979 | Yajima et al. | 75/204 |
| 4,141,802 | 2/1979 | Duparque et al. | 427/34 |
| 4,250,610 | 2/1981 | Wilbers et al. | 148/11.5 F |
| 4,499,156 | 2/1985 | Smith et al. | 148/11.5 F |
| 4,518,625 | 5/1985 | Westfall | 427/37 |
| 4,609,528 | 9/1986 | Chang et al. | 75/0.5 C |
| 4,613,480 | 9/1986 | Chang et al. | 75/0.5 C |
| 4,614,690 | 9/1986 | Yamamura et al. | 428/614 |
| 4,746,374 | 5/1988 | Froes et al. | 148/11.5 F |
| 4,805,833 | 2/1989 | Seimers | 427/37 |
| 4,842,820 | 6/1989 | Huang et al. | 420/421 |

*Primary Examiner*—Upendra Roy
*Attorney, Agent, or Firm*—Fred J. Baehr, Jr.

[57] ABSTRACT

A method of fabricating intermetallic compounds of TiAl and $TiAl_3$ into shapes including a foil utilizing an arc spray process in which bimetalic titanium aluminum or low titanium aluminum and low aluminum titanium wires of the proper proportions are used to form an intermetallic compound overlay, which is densified to form the shape.

13 Claims, 2 Drawing Sheets

METHOD OF FABRICATING SHAPED BRITTLE INTERMETALLIC COMPOUNDS

BACKGROUND OF THE INVENTION

The invention relates to a method of making a shape and more particularly to a method of forming titanium aluminide shapes utilizing an arc spray to form the desired titanium aluminide intermetallic compound.

U.S. Pat. No. 4,746,374 describes a method for fabricating an improved titanium aluminum alloy composite consisting of at least one high strength, high stiffness filament or fiber embedded in a titanium-aluminum base alloy matrix which comprises the steps of providing a rapidly solidified foil made of the titanium-aluminum base alloy, fabricating a preform consisting of alternating layers of the rapidly solidified foil and the filamentary material, and applying heat and pressure to consolidate the preform, wherein consolidation is carried out at a temperature below the beta-transus temperature of the alloy. The techniques suggested for producing rapidly solidified foil, includes Chill Block Melt Spinning, planar Flow Casting, Melt Overflow and Pendant Drop Melt Extraction. Such production methods are costly.

U.S. Pat. No. 4,518,625 describes arc metal spraying used to spray liquid metal onto an array of high strength fibers that have been previously wound onto a large drum or mandrel contained inside a controlled atmosphere chamber. This chamber is first evacuated to remove gaseous contaminants and then back filled with a neutral gas up to atmospheric pressure. This process is used to produce a large size metal matrix composite monotape.

SUMMARY OF THE INVENTION

Among the objects of the invention may be noted the provision of a method of forming a variety of shapes including foils of intermetallic compounds such as for example titanium and aluminum economically and particularly forming TiAl and $TiAl_3$ intermetallic compound foils, which are generally brittle and difficult to form into various shapes including foils.

In general, a method of fabricating shapes of brittle compounds such as titanium aluminide when performed in accordance with this invention, comprises the steps of forming two wires each containing predetermined quantities of two metals such as titanium and aluminum; utilizing the titanium and aluminum wires in an arc spray process to spray a film of molten metal from the wires on a drum or other pattern to form a intermetallic compound of titanium and aluminum overlaying the drum or other pattern and removing the intermetallic compound overlay from the drum or other pattern and densifying the overlay to form a foil or other shape.

BRIEF DESCRIPTION OF THE DRAWINGS

The invention as set forth in the claims will become more apparent by reading the following detailed description in conjunction with the accompanying drawings, and in which:

DESCRIPTION OF THE PREFERRED EMBODIMENT

Figure 1:
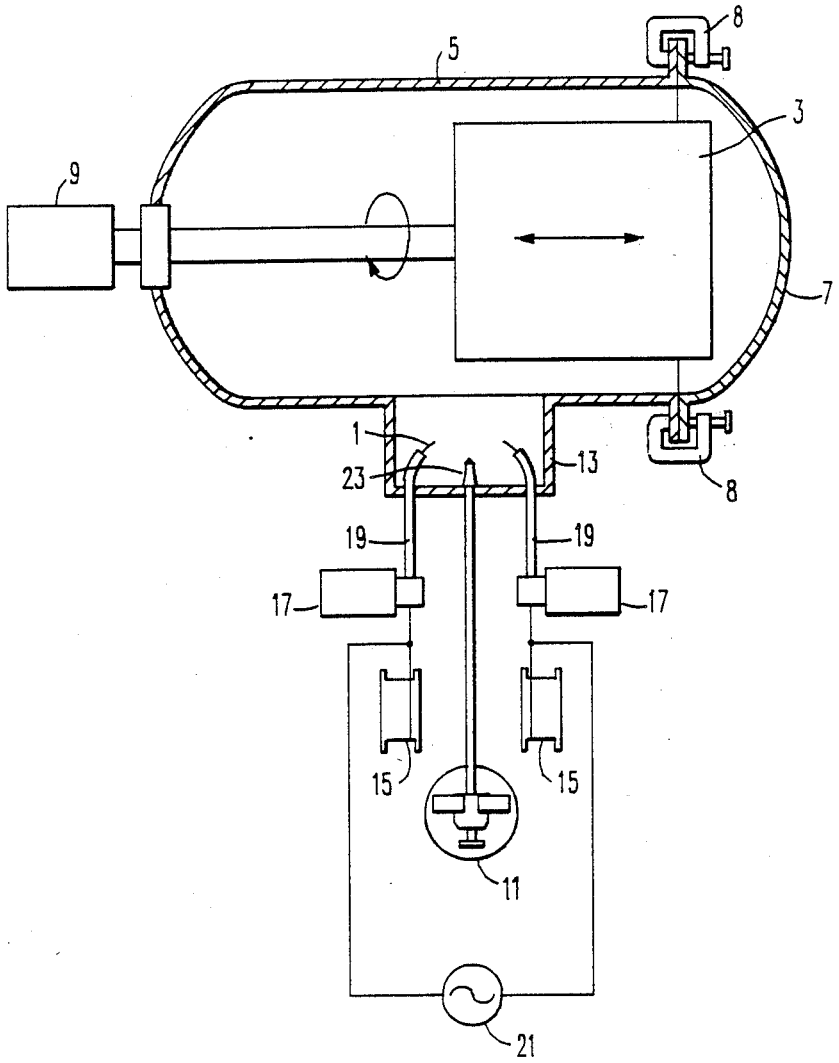
FIG. 1 is a schematic drawing of the apparatus utilized in the arc spray process.

Referring now to the drawings in detail and in particular to FIG. 1 there is shown a schematic of apparatus utilized in an arc spray process, which deposits spray from wires 1 melted by an arc on a mandrel or drum 3. The mandrel 3 is disposed in a vessel 5 having a head 7 sealably affixed to the vessel by hinged C-clamps 8. The drum 3 is removably attached to a drive mechanism 9, which rotates the drum 3 and moves it axially within the vessel 5 causing the stream of molten metal from the arc spray to trace a spiral path over the outside of the drum 3, while a drum 3 is shown it is understood that flat or other shaped surfaces could be utilized as a target surface and what is required is relative movement between the target surface and the arc spray. A vacuum pump (not shown) is used to evacuate the vessel 5 prior to filling it with inert gas supplied from a tank 11. An arc spray chamber 13 is disposed on one side of the vessel 5 and opens thereto. A pair of wire feeding devices comprising a pair of spools 15 containing the desired wire, a pair of variable speed independently controlled wire drive mechanisms 17 and a pair of wire tubes 19, which cooperate to feed two wires 1 into the arc spray chamber 13 so that the distal ends of the wires 1 move toward each other at a controlled rate. An alternating current or AC power supply 21 is connected to the wires 1 to apply a sufficiently high AC voltage to the wires to produce an arc between the distal ends of the wires 1 causing the distal ends to melt. Inert gas from the tank 11 is fed through a nozzle 23 to produce a high velocity stream which blows a stream of molten metal from the distal ends of the wire 1 toward the drum 3. The drum 3 is preferably made of a material having high thermal conductivity such as copper or aluminum and may be coated with a ceramic to slightly inhibit the heat transfer to provide time for the molten spray overlaying-the drum 3 to interfuse and homogenize.

The drum 3 is generally cylindrical with a rough surface on its outer periphery formed by rough emery paper or rough grit, sand or glass bead blasting. Preferably such a surface will have a root mean square, rms, roughness value of approximately 50 or more. In the production of foil in addition to the requirement of a rough surface, 50 rms or greater, a few wraps of wire or filaments on each end of the drum 3 is utilized to define the lateral edges of the foil, to prevent tearing of the fragile edges of the foil during removal of the foil from the drum 3 and provide a surface to which the molten stream from the arc spray will adhere.

Figure 2:
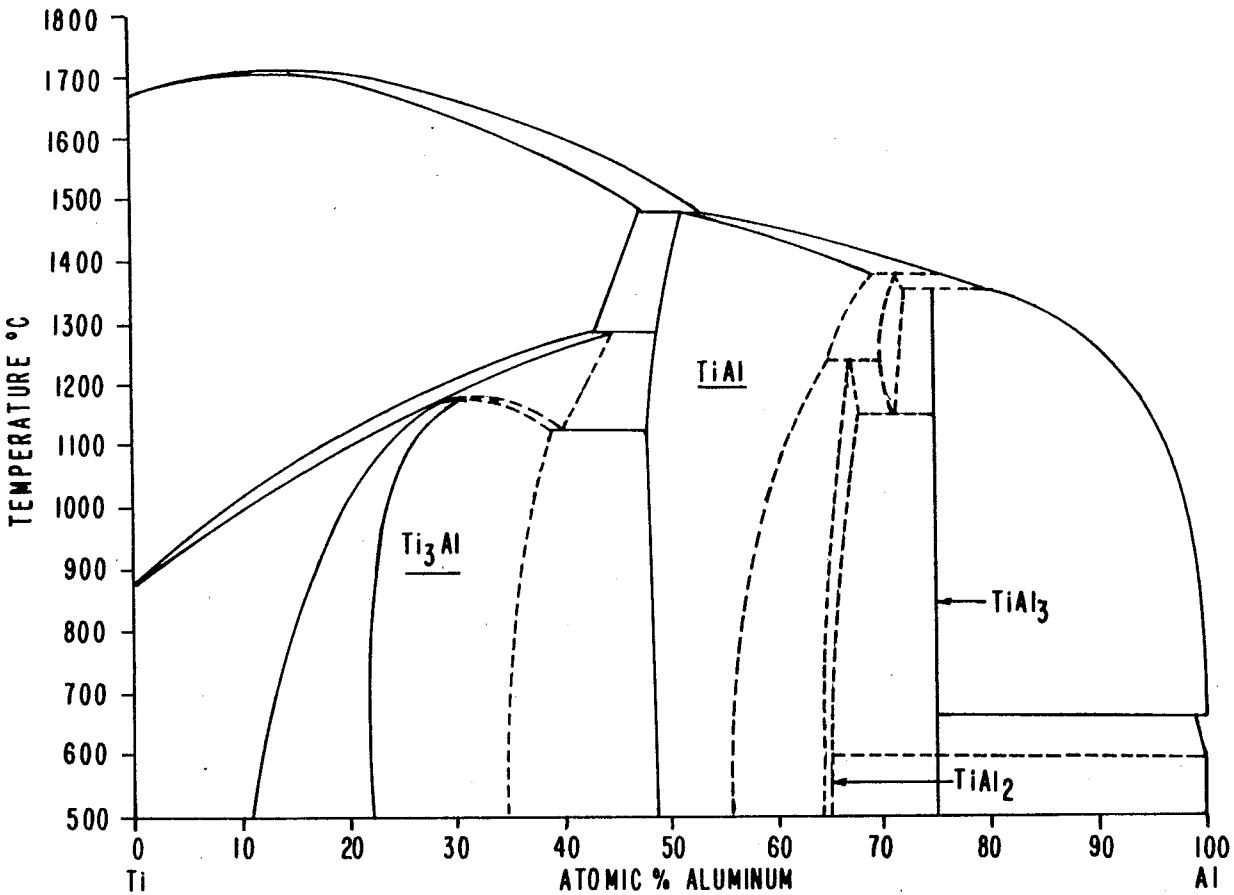
FIG. 2 is a titanium-aluminum phase diagram.

FIG. 2 shows a phase diagram for titanium-aluminum and while most of the alloys thereof can be produced by the process described herein, the process is particularly useful for forming TiAl which generally comprises 49 to 58%. Aluminum based on atomic percentages and $TiAl_3$ which generally comprises 74 to 76% Aluminum based on atomic percentages. The reason these particular intermetallic compounds are singled out is that they are generally brittle and very difficult to roll into a foil. It is even difficult to cast TiAl with out cracks due to stress cracking during cooling and rolling is more of a problem. While we are describing titanium aluminum intermetallic compounds, it is understood that other inter metallic compounds could also be produced for example $Ni_3Al$ and that small quantities of other and alloying elements such as niobium, tungsten and/or molybdenum or other alloying materials can be added as desired by adding the material to the aluminum or titanium or both as required.

The method of operating the arc spray to produce a titanium aluminum intermetallic foil is as follows: wire comprising the desired amounts of titanium and aluminum are formed as bimetallic wires, mechanically and/or metallurgically bonded together for example a titanium core maybe encircled with an aluminum tube or foil which is swaged tightly to the core forming a bimetallic wire of the desired proportions or ribbons of aluminum and titanium may be bonded by rolling and then drawn into a bimetallic wire of the desired proportions. Alternately dilute alloys of aluminum in titanium and titanium in aluminum can be made into wire and the composition of each wire can be adjusted so that when combined in the arc spray process the desired final intermetallic compounds of titanium and aluminum can be formed on the drum 3. Alternately, a tube of Al or Ti may be filled with Ti or Al powder or a powder containing both Ti and Al in the proper proportions to form the desired intermetallic compound. The composite tube and powder is made into a wire by swaging and or drawing and the wire is utilized in the arc spray process.

The arc in the arc spray process is very hot producing temperatures in the range of 10,000° F. so that aluminum and titanium will melt in close proximity to each other allowing them to interfuse and homogenize in liquid metal droplets and the high velocity gas stream of the arc spray process atomizes the liquid metal droplets and directs the atomized liquid metal toward the target or drum 3 upon which they impinge. Interdiffussion and homogenization occurs while the Ti and Al are in the liquid state and the small size of the liquid metal droplets will encourage homogenization. The liquid droplets impinge on the target or drum 3 and solidify to form intermetallic compounds of titanium and aluminum overlaying the target or drum 3. Maintaining the deposit at elevated temperature on the substrate will allow solid state diffusion and assist homogenization. The intermetallic compound of titanium and aluminum overlay is removed from the drum 3, and densified to form a full density intermetallic compound of titanium aluminide. The densifying can be by hot isostatic pressing in an envelope or the overlay can be hot pressed and/or pack rolled at elevated temperatures to produce a fully dense shape or foil.

While the preferred embodiments described herein set forth the best mode to practice this invention presently contemplated by the inventor, numerous modifications and adaptations of this invention will be apparent to others skilled in the art. Therefore, the embodiments are to be considered as illustrative and exemplary and it is understood that numerous modifications and adaptations of the invention as described in the claims will be apparent to those skilled in the art. Thus, the claims are intended to cover such modifications and adaptations as they are considered to be within the spirit and scope of this invention.

What is claimed is:

1. A method of fabricating shapes of brittle intermetallic compounds of various metals comprising the steps of forming two bimetallic wires of predetermined quantities of two different metals;

utilizing the wires that include the two different metals in an arc spray process to spray molten droplets of the two metals from the wires on a target to form an overlay of a desired brittle intermetallic compound of the two metals on the target;

removing the intermetallic compound overlay from the target; and densifying the overlay removed from the target to form a full density intermetallic shape.

2. The method of fabricating shapes of brittle intermetallic compounds as set forth in claim 1, wherein the step of forming two bimetallic wires of predetermined quantities of two metals comprises forming each of the wires with a core of at least one of said metals surrounded by a sheath of the other of said metals, the metals being proportioned to provide the desired intermetallic compound.

3. The method of fabricating shapes of brittle intermetallic compounds as set forth in claim 1, wherein the step of densifying the overlay removed from the target to form the shapes comprises isostatic hot pressing the overlay.

4. The method of fabricating shapes of brittle intermetallic compounds as set forth in claim 1, wherein the step of densifying the overlay removed from the target to form the shapes comprises pack rolling the overlay at elevated temperatures.

5. The method of fabricating shapes of brittle intermetallic compounds as set forth in claim 1, wherein the step of densifying the overlay removed from the target to form the shapes comprises hot pressing the overlay.

6. The method of fabricating shapes of brittle intermetallic compounds as set forth in claim 1, wherein the step of forming two bimetallic wires of predetermined quantities of two metals comprises forming the bimetallic wires of titanium and aluminum.

7. The method of fabricating shapes of intermetallic compounds as set forth in claim 1, wherein the step of forming two bimetallic wires of predetermined quantities of two metals comprises forming the wires of nickel and aluminum to form an intermetallic compound $Ni_3Al$.

8. The method of fabricating shapes of brittle intermetallic compounds as set forth in claim 1, wherein the step of forming two wires of predetermined quantities of two metals comprises forming the wires of titanium and aluminum.

9. The method of fabricating shapes of brittle intermetallic compounds as set forth in claim 2, wherein the intermetallic compound comprises a group of titanium aluminum intermetallic compounds comprising TiAl and $TiAl_3$.

10. The method of fabricating shapes of brittle intermetallic compounds as set forth in claim 8, wherein the intermetallic compound comprise a group of titanium aluminum intermetallic compounds comprising TiAl and $TiAl_3$.

11. A method of fabricating shapes of brittle intermetallic compounds of metals comprising the steps of forming two wires, each wire having different predetermined quantities of two metals;

utilizing the wires that include the two different quantities of the metals in an arc spray process to spray molten droplets of the two metals from the wires on a target to form an overlay of a desired intermetallic compound of the two metals on the target;

removing the intermetallic compound overlay from the target; and densifying the overlay removed from the target to form a full density intermetallic shape.

12. The method of fabricating shapes of brittle intermetallic compounds as set forth in claim 11, wherein the step of forming two wires of different predetermined quantities of two metals comprises forming alloy wires wherein one of the wires is formed from a low alloy of one of the two metals and the other wire is formed from a low alloy of the other of the two metals proportioned to provide the desired intermetallic compound of the two metals.

13. The method of fabricating shapes of brittle intermetallic compounds as set forth in claim 11, wherein the step of forming two wires of predetermined quantities of two metals comprises forming the wires of nickel and aluminum to form intermetallic compounds such as $Ni_3Al$.

* * * * *